US010419847B2

(12) United States Patent
Choi et al.

(10) Patent No.: US 10,419,847 B2
(45) Date of Patent: Sep. 17, 2019

(54) MICROSPEAKER ENCLOSURE WITH POROUS MATERIALS IN RESONANCE SPACE

(71) Applicant: EM-TECH. Co., Ltd., Busan (KR)

(72) Inventors: Kyu Dong Choi, Gyeongsangnam-do (KR); Jong Heon Ha, Gyeongsangnam-do (KR); Hyeon Taek Oh, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 32 days.

(21) Appl. No.: 15/615,155

(22) Filed: Jun. 6, 2017

(65) Prior Publication Data

US 2017/0353785 A1 Dec. 7, 2017

(30) Foreign Application Priority Data

Jun. 7, 2016 (KR) ..... 10-2016-0070269

(51) Int. Cl.
*H04R 25/00* (2006.01)
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
CPC ..... H04R 1/288; H04R 1/025
USPC ..... 381/354
See application file for complete search history.

(56) References Cited

U.S. PATENT DOCUMENTS 3,690,405 A * 9/1972 Hance ..... H04R 1/2819 181/155
3,720,285 A * 3/1973 Russell ..... H04R 1/288 181/151
3,786,202 A * 1/1974 Schafft ..... H04R 17/00 310/324
4,152,552 A * 5/1979 Meyer ..... H04R 1/30 181/159
4,439,644 A * 3/1984 Bruney, III ..... G10K 11/002 181/151
4,742,887 A * 5/1988 Yamagishi ..... H04R 1/2857 181/129
7,743,880 B2 * 6/2010 Matsumura ..... B61D 17/185 181/151
7,953,240 B2 * 5/2011 Matsumura ..... H04R 1/2803 381/150
8,687,836 B2 4/2014 Lin
(Continued)

FOREIGN PATENT DOCUMENTS

EP 2424270 B1 5/2014

*Primary Examiner* — Phylesha Dabney
(74) *Attorney, Agent, or Firm* — Murphy, Bilak & Homiller, PLLC

(57) ABSTRACT

The present invention discloses a microspeaker enclosure with porous materials, including a microspeaker, an enclosure with the microspeaker therein, the enclosure defining a resonance space and having an upper casing and a lower casing, porous materials filled in the resonance space of the enclosure, and an anti-noise structure which prevents at least one of a collision between the porous materials, a collision between the porous materials and the enclosure, a collision between the porous materials and the microspeaker, and introduction of the porous materials into the microspeaker.

18 Claims, 5 Drawing Sheets

(56) References Cited

U.S. PATENT DOCUMENTS

| | | | | |
|---|---|---|---|---|
| 8,942,402 | B2 * | 1/2015 | Yuasa | H04R 1/02 381/332 |
| 2006/0269095 | A1 * | 11/2006 | Matsumura | H04R 1/2803 381/421 |
| 2008/0135327 | A1 * | 6/2008 | Matsumura | B61D 17/185 181/151 |
| 2008/0170737 | A1 * | 7/2008 | Saiki | H04R 1/2803 381/346 |
| 2014/0064540 | A1 * | 3/2014 | Lin | H04R 1/2803 381/346 |
| 2017/0208386 | A1 * | 7/2017 | Yang | H04R 1/22 |
| 2018/0027322 | A1 * | 1/2018 | Shi | H04R 1/288 381/353 |
| 2018/0124502 | A1 | 5/2018 | Liu et al. | |

* cited by examiner

MICROSPEAKER ENCLOSURE WITH POROUS MATERIALS IN RESONANCE SPACE

PRIORITY CLAIM

The present application claims priority to Korean Patent Application No. 10-2016-0070269 filed on 7 Jun. 2016, the content of said application incorporated herein by reference in its entirety.

TECHNICAL FIELD

The present invention relates to a microspeaker enclosure with porous materials in a resonance space, for increasing low-frequency sound pressure level (SPL) and decreasing low-frequency total harmonic distortion (THD).

BACKGROUND

A microspeaker is provided in a portable device, etc. to generate the sound. With recent developments of mobile devices, the microspeaker has been mounted in various mobile devices. In particular, the latest mobile devices tend to have a light weight, small size, and slim shape to facilitate portability, and accordingly, the microspeaker mounted in the mobile devices is required to have a small size and slim shape.

However, for a microspeaker having a small size and slim shape, an area of a diaphragm decreases, and a volume of a resonance space, in which the sound generated by the vibration of the diaphragm is resonated and amplified, also decreases, as a result of which a sound pressure decreases. Such decrease in the sound pressure is particularly pronounced at low frequencies. According to the prior art, in order to enhance a low-frequency sound pressure, air adsorbents which are porous materials are arranged in a resonance space, such that the porous materials adsorb air molecules to define a virtual acoustic space, which results in increased low-frequency SPL and decreased low-frequency THD. Examples of efforts in this regard include EP 2,424,270 B1 and U.S. Pat. No. 8,687,836 B2.

As illustrated in FIG. 1, the applicant has also developed a technology of filling air adsorbents in an enclosure with a microspeaker therein so as to increase low-frequency SPL. A microspeaker A is mounted in an enclosure, a predetermined amount of porous materials n are filled in a resonance space (back volume) in the enclosure, and the air occupies the remaining space. The enclosure includes an upper casing 11, a lower casing 12, a filling hole 13 which is formed in the lower casing 12 and through which the porous materials are to be filled in the enclosure, and a cover 14 for covering the filling hole 13. A support member 21 and 22 may be provided in the upper casing 11 or the lower casing 12, that serve to guide the microspeaker A to be properly mounted and also serve to separate the microspeaker A from the lower casing 12 so that the air can smoothly flow in and out via a vent hole formed in a yoke of the microspeaker A. The support members 21 and 22 can be integrally formed with the upper casing 11 and the lower casing 12, respectively.

However, as can be seen in FIG. 1, if the porous materials n are not filled in the resonance space up to 100% during the filling of the porous materials, the porous materials n may collide with one another and with the enclosure 11, 12 and 14 or the microspeaker A, causing noise. Such noise definitely results from the vibration of the porous materials n, since it is not generated without the movement of the porous materials. Therefore, in the case that the porous materials are filled in the resonance space, if the microspeaker generates the sound, it can be seen that such sound is caused by the collision between the inner components of the enclosure and the porous materials. Thus, there is the need to remove noise caused by the vibration of the porous materials, while increasing low-frequency SPL and decreasing low-frequency THD by the porous materials.

SUMMARY

An object of the present invention is to provide a structure for removing noise caused by the vibration generated by porous materials, which are filled in a resonance space of a microspeaker enclosure, so as to increase low-frequency SPL and decrease low-frequency THD.

According to an aspect of the present invention, there is provided a microspeaker enclosure with porous materials, including a microspeaker, an enclosure with the microspeaker therein, the enclosure defining a resonance space and having an upper casing and a lower casing, porous materials filled in the resonance space of the enclosure, and an anti-noise structure which prevents at least one of a collision between the porous materials, a collision between the porous materials and the enclosure, a collision between the porous materials and the microspeaker, and introduction of the porous materials into the microspeaker.

In some embodiments, the lower casing of the enclosure further includes a filling hole, through which the porous materials are to be filled, and a cover for covering the filling hole, the cover being provided with an elastic foam inserted into the resonance space to prevent the vibration of the porous materials.

In some embodiments, an adhesive member is applied to the inner surface of the enclosure, such that some of the porous materials are attached thereto.

In some embodiments, an elastic foam is applied to the inner surface of the enclosure.

In some embodiments, the porous materials are filled in an air-permeable pouch, and then the pouch is disposed in the resonance space.

In some embodiments, the microspeaker enclosure further includes an elastic foam surrounding the periphery of the microspeaker, wherein the porous materials are filled outside the elastic foam.

In some embodiments, an elastic foam is disposed between the bottom surface of the microspeaker and the lower casing, the elastic foam covering the entire bottom surface of the microspeaker.

In some embodiments, the porous materials are filled in the resonance space of the enclosure together with cotton.

In some embodiments, an adhesive member to which some of the porous materials are attached is provided on the inner surface of the enclosure, a filling space, which is defined by the adhesive member and the elastic foam, is formed in the resonance space, and the porous materials are filled in the filling space.

The microspeaker enclosure with the porous materials according to the present invention can advantageously prevent noise by preventing the collision between the porous materials, the collision between the porous materials and the enclosure, and the collision between the porous materials and the microspeaker, which are caused by the vibration of the porous materials.

In addition, the microspeaker enclosure with the porous materials according to the present invention can prevent noise by preventing the porous materials from being introduced into the microspeaker.

Those skilled in the art will recognize additional features and advantages upon reading the following detailed description, and upon viewing the accompanying drawings.

DETAILED DESCRIPTION

Hereinafter, preferred embodiments of a microspeaker enclosure with porous materials in a resonance space according to the present invention will be described in detail with reference to the accompanying drawings.

Figure 1:
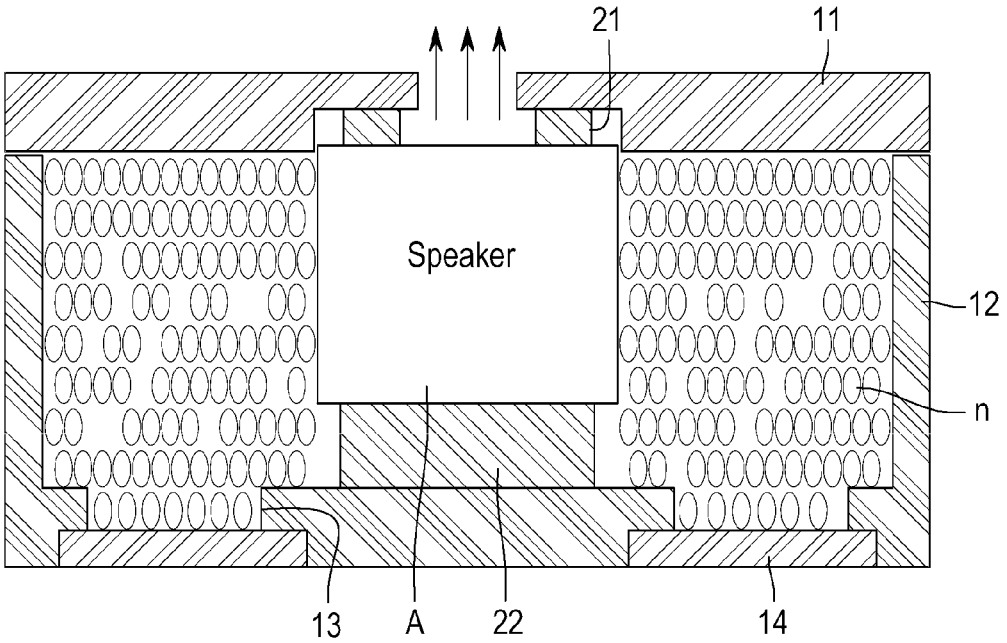
Fig.1 (PRIOR ART)
FIG. 1 illustrates a conventional microspeaker enclosure with porous materials.
Figure 2:
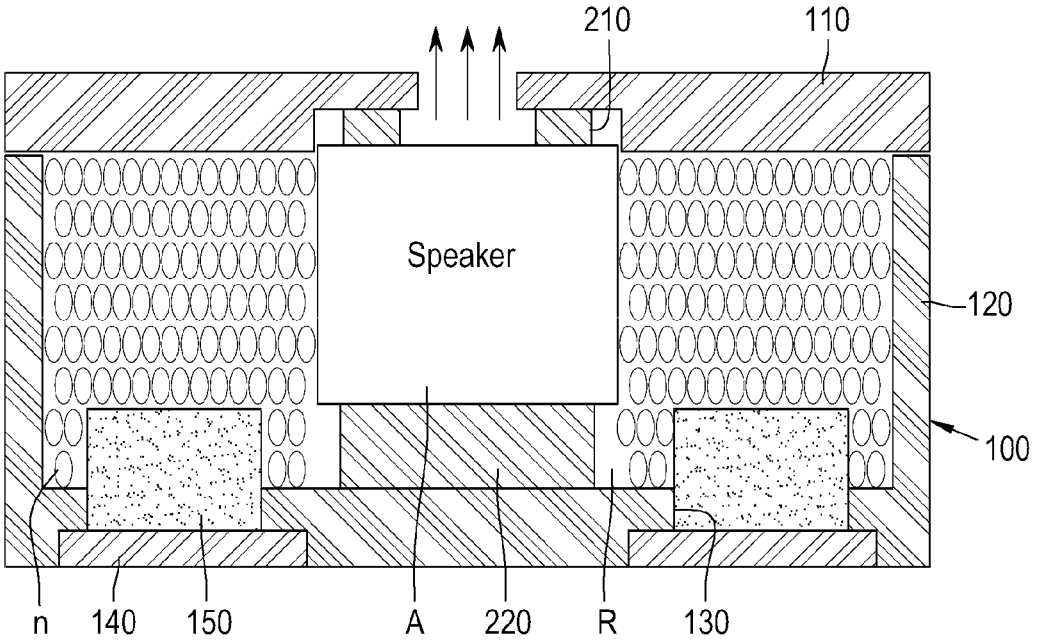
FIG. 2 illustrates a microspeaker enclosure with porous materials according to a first embodiment of the present invention.

FIG. 2 illustrates a microspeaker enclosure with porous materials according to a first embodiment of the present invention.

The microspeaker enclosure with the porous materials according to the first embodiment of the present invention includes a microspeaker A, an enclosure 100 with the microspeaker A therein, the enclosure defining a resonance space R and having an upper casing 110 and a lower casing 120, and porous materials n filled in the resonance space R of the enclosure 100. In addition, support members 210 and 220 are disposed between the upper casing 110 and the microspeaker A and between the lower casing 120 and the microspeaker A, respectively, to support the microspeaker A. Here, a filling hole 130 is formed in the lower casing 120, through which the porous materials n are filled in the resonance space R after the assembly of the enclosure 100 and the microspeaker A. Moreover, a cover 140 is provided that covers the filling hole 130 after the filling of the porous materials n.

When the porous materials n are filled in the resonance space R through the filling hole 130, it is almost impossible that the porous materials n are fully filled to the extent that they do not move at all, in spite of sound generation of the microspeaker A, movement of the enclosure 100, or impact. Therefore, there is a problem that noise is generated due to the collision between the porous materials n, the collision between the porous materials n and the enclosure 100, or the collision between the porous materials n and the microspeaker A, which are caused by the sound generated by the microspeaker A, and furthermore, the introduction of the porous materials n into the microspeaker A. As a result, a structure capable of preventing such noise is necessary.

The microspeaker enclosure with the porous materials according to the first embodiment of the present invention further includes, on the cover 140, an elastic foam 150 inserted into the resonance space R to minimize air gaps between the porous materials n, as an anti-noise structure. After the porous materials n are filled in the resonance space R, when the cover 140 closes the filling hole 130, the elastic foam 150 enters the resonance space R, occupying a predetermined space of the resonance space R and thus reducing a space in which the porous materials n can stay. While the elastic foam 150 is inserted into the resonance space R, when the air gaps between the porous materials n are minimized to the extent that the elastic foam 150 cannot reduce the size of the space in which the porous materials n can stay, the elastic foam 150 is subject to contractive deformation. As the elastic foam 150 removes the spatial margin in which the porous materials n can vibrate respectively, the porous materials n cannot vibrate respectively in spite of the sound generated by the microspeaker A. Consequently, it is possible to remove noise caused by the vibration of the respective porous materials n, by reducing the collision between the porous materials, the collision between the porous materials and the enclosure, and the collision between the porous materials and the microspeaker. The resulting structure of the cover 140 and the elastic foam 150 of FIG. 2 can be applied to the second to ninth embodiments of the present invention.

Figure 3:
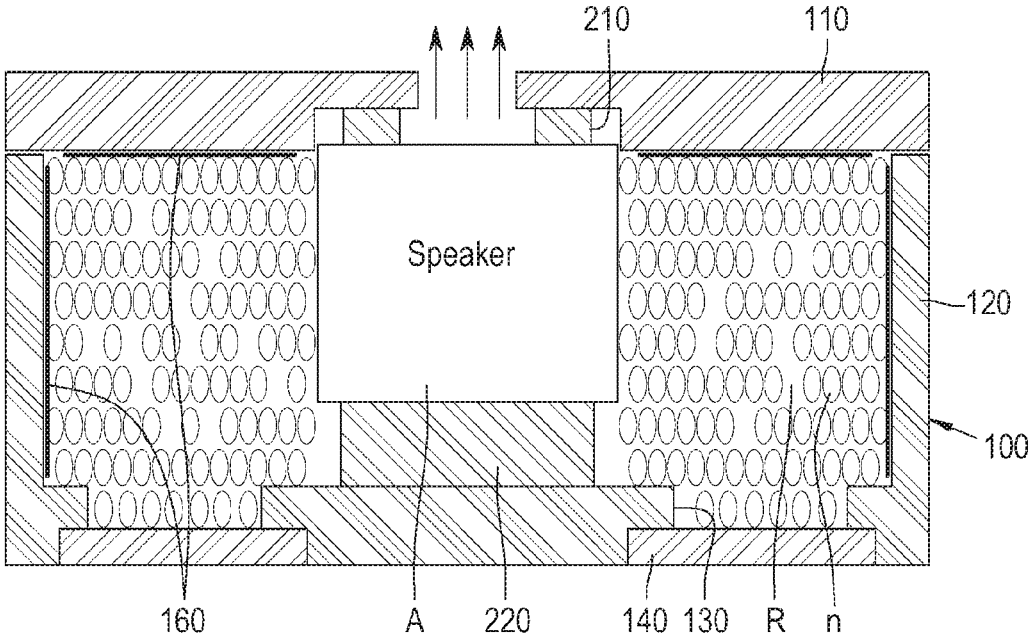
FIG. 3 illustrates a microspeaker enclosure with porous materials according to a second embodiment of the present invention.

FIG. 3 illustrates a microspeaker enclosure with porous materials according to a second embodiment of the present invention. The microspeaker enclosure with the porous materials according to the second embodiment of the present invention has the same configuration as the microspeaker enclosure with the porous materials according to the first embodiment of the present invention, except for an anti-noise structure for preventing noise caused by the porous materials n.

The microspeaker enclosure with the porous materials according to the second embodiment of the present invention is characterized in that a double-sided tape 160, which is an adhesive member, is attached to the inner surface of the enclosure 100, as the anti-noise structure. The double-sided tape 160 can be attached to the bottom surface of the upper casing 110 and the inside surface of the lower casing 120. The double-sided tape 160 is attached to the upper casing 110 and the lower casing 120, the upper casing 110 and the lower casing 120 are subsequently coupled to each other, the porous materials n are filled through the filling hole 130, and then the filling hole 130 is closed by the cover 140. With this structure, some of the porous materials n are attached to the double-sided tape 160, which makes it possible to reduce noise generated by the collision between the enclosure 100 and the porous materials n. Moreover, the elastic foam 150 attached to the cover 140 of FIG. 2 can be applied to improve the adhesive performance (adhesive number, adhesive surface area) between the porous materials n and the double-sided tape 160.

Figure 4:
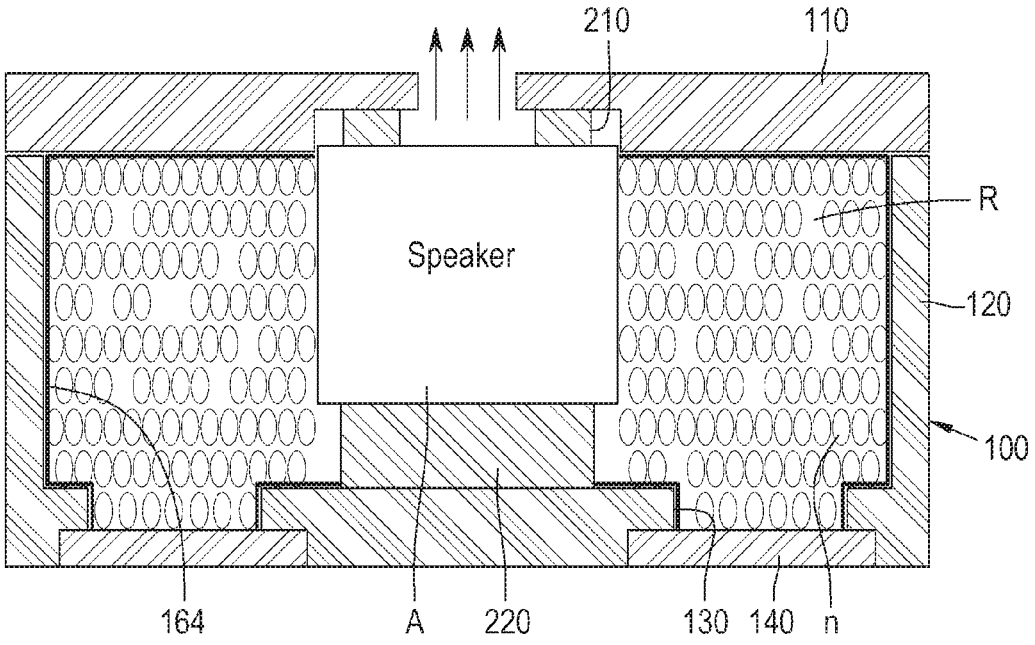
FIG. 4 illustrates a microspeaker enclosure with porous materials according to a third embodiment of the present invention.

FIG. 4 illustrates a microspeaker enclosure with porous materials according to a third embodiment of the present invention. The microspeaker enclosure with the porous materials according to the third embodiment of the present invention has the same configuration as the microspeaker enclosures with the porous materials according to the first and second embodiments of the present invention, except for an anti-noise structure for preventing noise caused by the porous materials n.

The microspeaker enclosure with the porous materials according to the third embodiment of the present invention is characterized in that an adhesive 164 is attached to the inner surface of the enclosure 100, as the anti-noise structure. The adhesive 164 can be applied to the bottom surface of the upper casing 110 and the inside surface of the lower casing 120. The adhesive 164 is preferably applied to the inner surface of the enclosure 100 using a spray, etc. Although the principle of preventing noise using the adhesive 164 is almost the same as the principle of the second embodiment using the double-sided tape 160, there is an advantage that the adhesive 164 can be applied to curved or narrow regions more easily than the double-sided tape 160. With this structure, some of the porous materials n are attached to the adhesive 164, which makes it possible to reduce noise generated by the collision between the enclosure 100 and the microspeaker A and the porous materials n. Further, the elastic foam 150 attached to the cover 140 of FIG. 2 can be applied to improve the adhesive performance (adhesive number, adhesive surface area) between the porous materials n and the adhesive 164.

Figure 5:
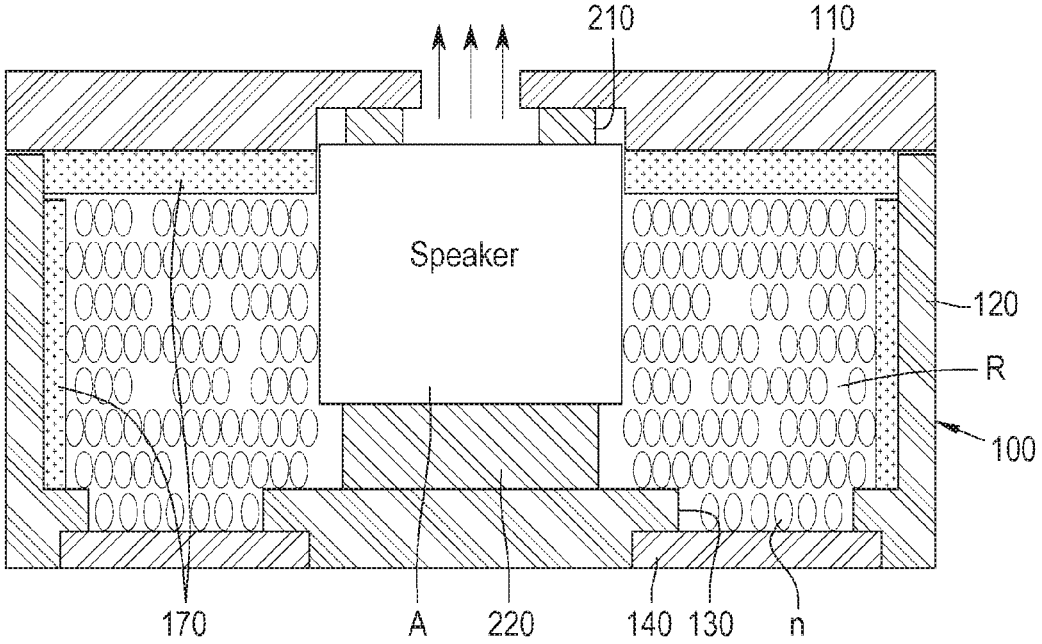
FIG. 5 illustrates a microspeaker enclosure with porous materials according to a fourth embodiment of the present invention.

FIG. 5 illustrates a microspeaker enclosure with porous materials according to a fourth embodiment of the present invention. The microspeaker enclosure with the porous materials according to the fourth embodiment of the present invention has the same configuration as the microspeaker enclosures with the porous materials according to the first to third embodiments of the present invention, except for an anti-noise structure for preventing noise caused by the porous materials n.

The microspeaker enclosure with the porous materials according to the fourth embodiment of the present invention is characterized in that an elastic foam 170 is attached to the inner surface of the enclosure 100, as the anti-noise structure. The elastic foam 170 can be mounted on the bottom surface of the upper casing 110 and the inside surface of the lower casing 120. Even if the porous materials n are not fully filled in the resonance space R to cause slight vibration, the porous materials n do not collide with the inner surface of the enclosure 100 but collide with the elastic foam 170 capable of absorbing impact, which makes it possible to reduce noise generated by the collision between the enclosure 100 and the porous materials n. In addition, the elastic foam 150 attached to the cover 140 of FIG. 2 can be applied to remove the air gaps between the porous materials n and the elastic foam 170, which makes it possible to efficiently remove noise caused by the collision.

Figure 6:
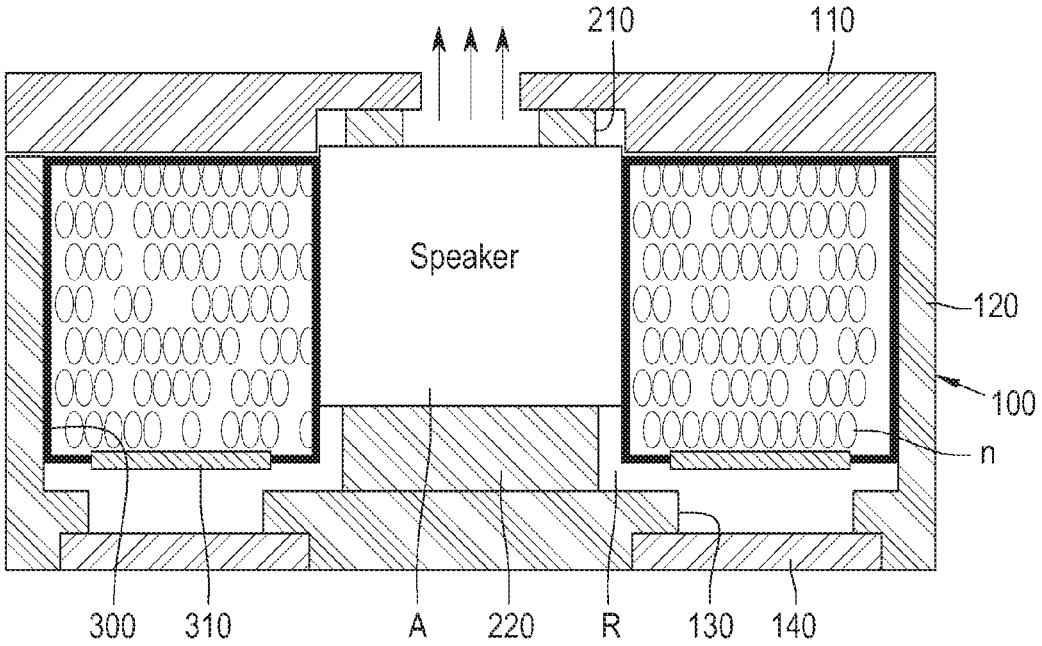
FIG. 6 illustrates a microspeaker enclosure with porous materials according to a fifth embodiment of the present invention.

FIG. 6 illustrates a microspeaker enclosure with porous materials according to a fifth embodiment of the present invention. The microspeaker enclosure with the porous materials according to the fifth embodiment of the present invention has the same configuration as the microspeaker enclosures with the porous materials according to the first to fourth embodiments of the present invention, except for an anti-noise structure for preventing noise caused by the porous materials n.

The microspeaker enclosure with the porous materials according to the fifth embodiment of the present invention is characterized in that the porous materials n are filled in an air-permeable pouch 300, and then the pouch is applied to the resonance space R. The air-permeable pouch 300 is attached to the upper casing 110, the lower casing 120, and the microspeaker A, which define the resonance space R. Here, the air cannot substantially permeable through the portions of the air-permeable pouch 300 that are attached to the upper casing 110, the lower casing 120, and the microspeaker A. Therefore, the portions of the air-permeable pouch 300 that are not attached to the resonance space R-defining surfaces are only air-permeable. Here, in the air-permeable portions, the porous materials n may escape the pouch 300 through fine holes and additionally cause noise. Accordingly, a filter 310 is provided in the air-permeable portions so that the porous materials n cannot escape the pouch 300. Alternatively, the entire pouch 300 may be formed from a fine filter material, which is air-permeable, but through which the porous materials n cannot pass.

Figure 7:
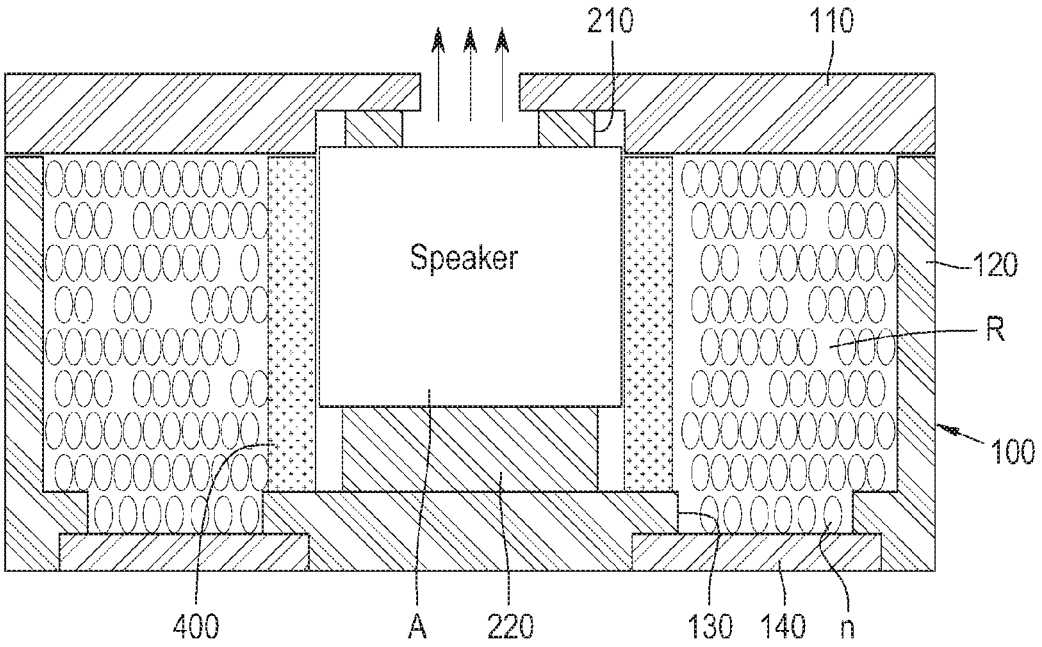
FIG. 7 illustrates a microspeaker enclosure with porous materials according to a sixth embodiment of the present invention.

FIG. 7 illustrates a microspeaker enclosure with porous materials according to a sixth embodiment of the present invention. The microspeaker enclosure with the porous materials according to the sixth embodiment of the present invention has the same configuration as the microspeaker enclosures with the porous materials according to the first to fifth embodiments of the present invention, except for an anti-noise structure for preventing noise caused by the porous materials n.

The microspeaker enclosure with the porous materials according to the sixth embodiment of the present invention is characterized in that a barrier wall 400 formed from an elastic foam is disposed outside the microspeaker A, as the anti-noise structure. Upon the assembly of the microspeaker A and the enclosure 100, the barrier wall 400 formed from the elastic foam is disposed around the microspeaker A. Then, the porous materials n are filled in the resonance space R, which makes it possible to reduce noise caused by the collision between the microspeaker A and the porous materials n. Moreover, it is also possible to prevent the porous materials n from being introduced into the microspeaker A through a vent hole formed in the bottom surface of the microspeaker A (when seen in the drawing), i.e., the yoke of the microspeaker A.

Figure 8:
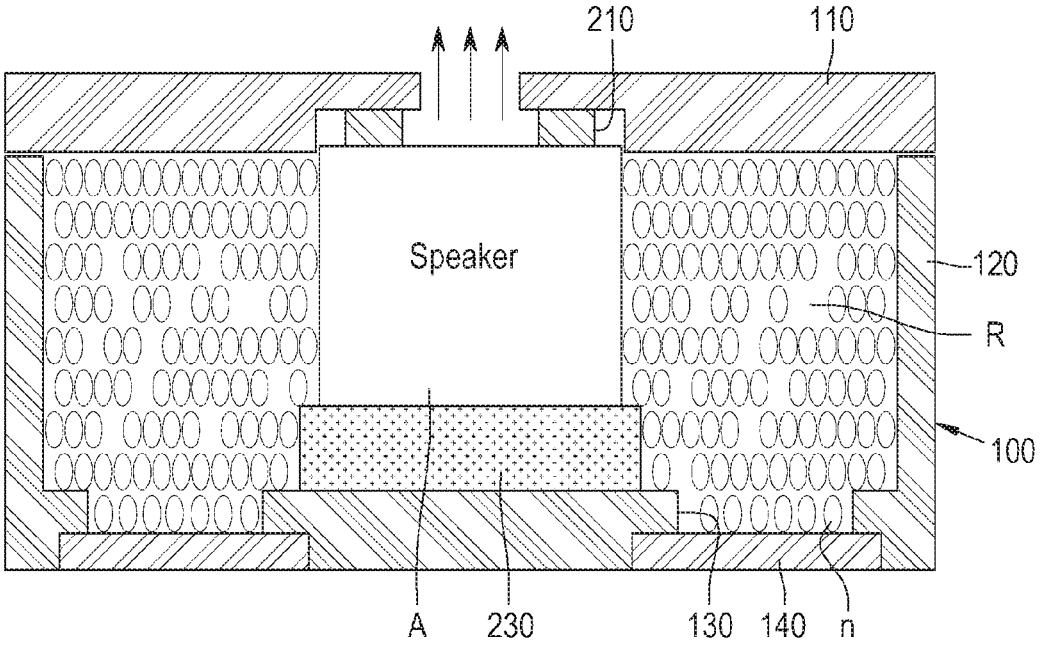
FIG. 8 illustrates a microspeaker enclosure with porous materials according to a seventh embodiment of the present invention.

FIG. 8 illustrates a microspeaker enclosure with porous materials according to a seventh embodiment of the present invention. The microspeaker enclosure with the porous materials according to the seventh embodiment of the present invention has the same configuration as the microspeaker enclosures with the porous materials according to the first to sixth embodiments of the present invention, except for the incorporation of the anti-noise structure for preventing noise caused by the porous materials n and the structure for securing the vent hole formed in the yoke of the microspeaker.

The microspeaker enclosure with the porous materials according to the seventh embodiment of the present invention is characterized in that an elastic foam 230 is disposed between the bottom surface of the microspeaker A and the lower casing 120, as the anti-noise structure. The elastic foam 230 is distinguished from the support member 220 (see FIGS. 2 to 7) of the first to sixth embodiments in that it covers the entire bottom surface of the microspeaker A, even including the vent hole. However, although the elastic foam 230 covers the vent hole formed in the microspeaker A, since it is air-permeable, it does not affect the operation of the microspeaker A. As such, the elastic foam 230 covers the vent hole formed in the microspeaker A, which makes it possible to prevent the porous materials n from being introduced into the microspeaker A.

Figure 9:
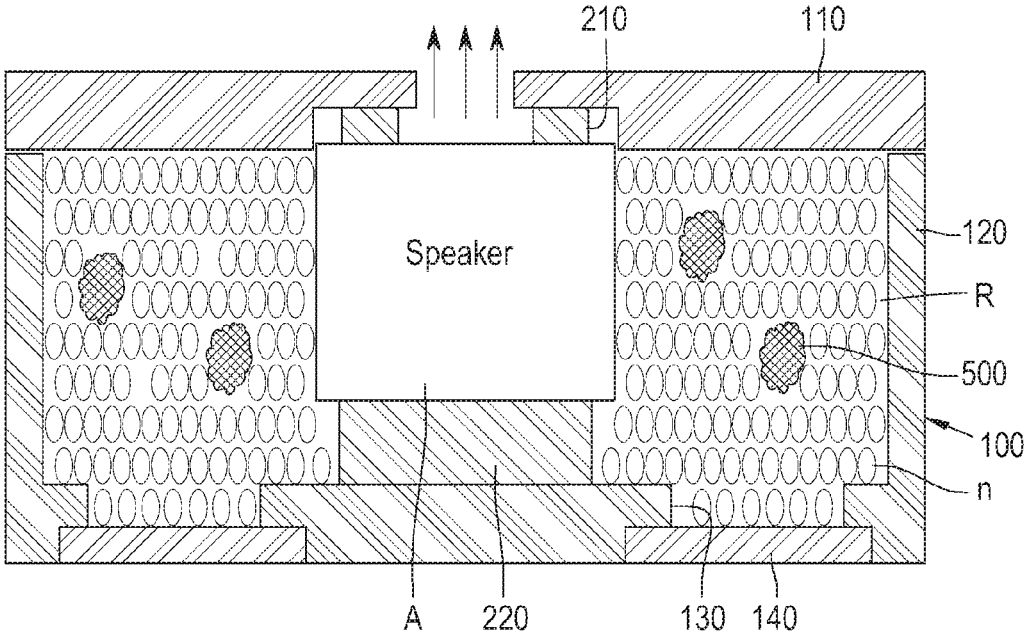
FIG. 9 illustrates a microspeaker enclosure with porous materials according to an eighth embodiment of the present invention.

FIG. 9 illustrates a microspeaker enclosure with porous materials according to an eighth embodiment of the present invention. The microspeaker enclosure with the porous materials according to the eighth embodiment of the present invention has the same configuration as the microspeaker enclosures with the porous materials according to the first to sixth embodiments of the present invention, except for an anti-noise structure for preventing noise caused by the porous materials n.

The microspeaker enclosure with the porous materials according to the eighth embodiment of the present invention is characterized in that the porous materials n are filled in the resonance space R together with at least one piece of cotton 500, as the anti-noise structure. The at least one piece of elastically-compressed cotton 500 is inserted during the filling of the porous materials n and expanded during the operation of the microspeaker A, to reduce the gaps between the porous materials 11 so that they are not moveable. Thus, it is possible to prevent noise caused by the movement of the respective porous materials n.

Figure 10:
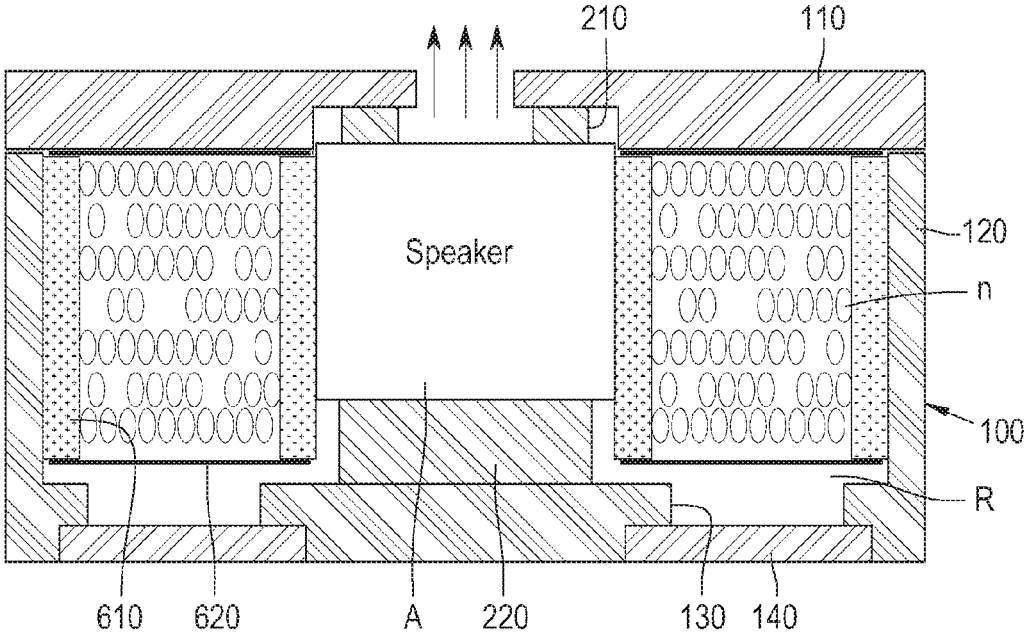
FIG. 10 illustrates a microspeaker enclosure with porous materials according to a ninth embodiment of the present invention.

FIG. 10 illustrates a microspeaker enclosure with porous materials according to a ninth embodiment of the present invention. The microspeaker enclosure with the porous materials according to the ninth embodiment of the present invention has the same configuration as the microspeaker enclosures with the porous materials according to the first to sixth and eighth embodiments of the present invention, except for an anti-noise structure for preventing noise caused by the porous materials n.

The microspeaker enclosure with the porous materials according to the ninth embodiment of the present invention is characterized in that a filling space, which is defined by an elastic foam 610 and an adhesive member 620, is formed in the resonance space R and the porous materials n are filled in the filling space. For example, as shown in FIG. 10, the elastic foams 610 are disposed opposite to the inside surface of the lower casing 120 and the outer surface of the microspeaker A in a first direction (vertical direction), respectively, and the adhesive members 620 are disposed opposite to the bottom surface of the upper casing 110 (the top surfaces of the elastic foams 610) and the bottom surfaces of the elastic foams 610 in a second direction orthogonal to the first direction (horizontal direction), respectively, to thereby define the filling space. There is an advantage that some of the porous materials n can be attached to the adhesive members 620 and noise caused by the collision of the porous materials n can be reduced by the elastic foams 610.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

While the present invention has been illustrated and described in connection with the accompanying drawings and the preferred embodiments, the present invention is not limited thereto and is defined by the appended claims. Instead, the present invention is limited only by the following claims and their legal equivalents. Therefore, it will be understood by those skilled in the art that various modifications and changes can be made thereto without departing from the spirit and scope of the invention defined by the appended claims.

What is claimed is:

1. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein the anti-noise structure is an elastic foam inserted into the resonance space.

2. The microspeaker enclosure of claim 1, wherein the elastic foam is applied to an inner surface of the enclosure.

3. The microspeaker enclosure of claim 1, wherein the porous materials are filled in an air-permeable pouch, and wherein the air-permeable pouch is disposed in the resonance space.

4. The microspeaker enclosure of claim 1, wherein the elastic foam surrounds the periphery of the microspeaker, wherein the porous materials are filled outside the elastic foam.

5. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein the lower casing of the enclosure further comprises a filling hole configured to receive the porous materials, and a cover for covering the filling hole, the cover being provided with an elastic foam inserted into the resonance space to prevent the vibration of the porous materials.

6. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein the anti-noise structure comprises an adhesive member applied to an inner surface of the enclosure, such that some of the porous materials are attached to the adhesive member.

7. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein an elastic foam is disposed between the bottom surface of the microspeaker and the lower casing, the elastic foam covering the entire bottom surface of the microspeaker.

8. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein the porous materials are filled in the resonance space of the enclosure together with cotton.

9. A microspeaker enclosure with porous materials, comprising:

a microspeaker;

an enclosure with the microspeaker therein, the enclosure defining a resonance space and having an upper casing and a lower casing;

porous materials filled in the resonance space of the enclosure; and an anti-noise structure configured to prevent at least one of a collision between the porous materials, a collision between the porous materials and the enclosure, a collision between the porous materials and the microspeaker, and introduction of the porous materials into the microspeaker, wherein an adhesive member to which some of the porous materials are attached is provided on an inner surface of the enclosure, wherein a filling space, which is defined by the adhesive member and an elastic foam, is formed in the resonance space, and wherein the porous materials are filled in the filling space.

10. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure; and providing an anti-noise structure configured to prevent at least one of a collision between the porous materials, a collision between the porous materials and the enclosure, a collision between the porous materials and the microspeaker, and introduction of the porous materials into the microspeaker, wherein the anti-noise structure is an elastic foam inserted into the resonance space.

11. The method of claim 10, wherein providing the anti-noise structure comprises applying the elastic foam to an inner surface of the enclosure.

12. The method of claim 10, wherein filling the porous materials in the resonance space comprises:

filling the porous materials in an air-permeable pouch; and placing the air-permeable pouch in the resonance space.

13. The method of claim 10, wherein providing the anti-noise structure comprises:

surrounding the periphery of the microspeaker with the elastic foam, wherein the porous materials are filled outside the elastic foam.

14. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure; and providing an anti-noise structure configured to prevent at least one of a collision between the porous materials, a collision between the porous materials and the enclosure, a collision between the porous materials and the microspeaker, and introduction of the porous materials into the microspeaker, wherein the lower casing of the enclosure further comprises a filling hole configured to receive the porous materials, and a cover for covering the filling hole, the cover being provided with an elastic foam inserted into the resonance space to prevent the vibration of the porous materials.

15. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure; and providing an anti-noise structure configured to prevent at least one of a collision between the porous materials, a collision between the porous materials and the enclosure, a collision between the porous materials and the microspeaker, and introduction of the porous materials into the microspeaker, wherein providing the anti-noise structure comprises applying an adhesive member to an inner surface of the enclosure, such that some of the porous materials are attached to the adhesive member.

16. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure;

providing an anti-noise structure configured to prevent at least one of a collision between the porous materials, a collision between the porous materials and the enclosure, a collision between the porous materials and the microspeaker, and introduction of the porous materials into the microspeaker; and providing an elastic foam between the bottom surface of the microspeaker and the lower casing, the elastic foam covering the entire bottom surface of the microspeaker.

17. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure; and providing an anti-noise structure configured to prevent at least one of a collision between the porous materials, a collision between the porous materials and the enclosure, a collision between the porous materials and the microspeaker, and introduction of the porous materials into the microspeaker, wherein the porous materials are filled in the resonance space of the enclosure together with cotton.

18. A method of manufacturing a microspeaker enclosure with porous materials, the method comprising:

placing a microspeaker in an enclosure, the enclosure defining a resonance space and having an upper casing and a lower casing;

filling porous materials in the resonance space of the enclosure;

providing an anti-noise structure configured to prevent at least one of a collision between the porous materials, a collision between the porous materials and the enclosure, a collision between the porous materials and the microspeaker, and introduction of the porous materials into the microspeaker;

providing an adhesive member to which some of the porous materials are attached on an inner surface of the enclosure, forming a filling space, defined by the adhesive member and an elastic foam, in the resonance space; and filling the porous materials in the filling space.

* * * * *